United States Patent [19]

Sasaki et al.

[11] Patent Number: 5,072,521

[45] Date of Patent: Dec. 17, 1991

[54] METHOD OF MAKING ELECTRICAL CONTACT

[75] Inventors: Noboru Sasaki; Masayuki Ueyama, both of Tsuruoka, Japan

[73] Assignee: Tanaka Kikinzoku Kogyo K.K., Tokyo, Japan

[21] Appl. No.: 675,849

[22] Filed: Mar. 27, 1991

Related U.S. Application Data

[60] Division of Ser. No. 161,237, Feb. 18, 1988, which is a continuation of Ser. No. 926,052, Nov. 3, 1986, abandoned.

[30] Foreign Application Priority Data

Dec. 17, 1985 [JP] Japan ..... 60-284086
Dec. 25, 1985 [JP] Japan ..... 60-295155

[51] Int. Cl.[5] ..... H01R 43/02

[52] U.S. Cl. ..... 29/879; 10/12 R; 10/25; 29/876; 29/882; 72/264

[58] Field of Search ..... 29/879, 882, 884, 876, 29/879; 10/25, 27 R, 12 R; 72/264

[56] References Cited

U.S. PATENT DOCUMENTS

| | | | |
|---|---|---|---|
| 3,387,481 | 6/1968 | Harvey et al. | 72/264 X |
| 3,720,805 | 3/1973 | Fitzgerald | 29/874 X |
| 3,737,999 | 6/1973 | Gwyn, Jr. | 29/882 |
| 4,232,812 | 11/1980 | Shibata | 29/882 X |
| 4,335,507 | 6/1982 | Shibata | 29/876 |
| 4,414,742 | 11/1983 | Shibata | 29/882 |
| 4,429,458 | 2/1984 | Shibata | 29/882 X |
| 4,446,618 | 5/1984 | Bellian | 29/882 |

*Primary Examiner*—Carl J. Arbes
*Attorney, Agent, or Firm*—Armstrong, Nikaido, Marmelstein, Kubovcik & Murray

[57] ABSTRACT

An electrical contact for switches, relays, voltage regulator and the like, which comprises a clad body having a contact segment of a contact stock such as silver, palladium or alloy thereof and a base segment of copper or its alloy, as a carrier of the contact segment, as well as a method of making same. The contact has a central opening passing through the contact and base segments in the body and a thickness of the contact segment is made larger at a peripheral area of the opening.

3 Claims, 6 Drawing Sheets

METHOD OF MAKING ELECTRICAL CONTACT

This is a division of application Ser. No. 161,237 filed Feb. 18, 1988, which in turn is a continuation of application Ser. No. 926,052, filed Nov. 3, 1986, now abandoned.

BACKGROUND OF THE INVENTION

1. Field of the Invention

The present invention relates to an electrical contact for switches, relays, voltage regulators and the like and more particularly to a so-called clad contact comprising a contact segment of a good contact stock such as silver, palladium or the like noble metal, or an alloy thereof and a base segment of copper or its alloy, as a carrier of the contact segment, as well as a method of making same. The contact has an opening therein. A form of the contact may be of a rivet or button.

2. Related Arts

An electrical contact with an opening therein has been proposed, for instance in U.S. Pat. Nos. 2,949,520 and 3,953,698. In the former, the opening is formed in spiral slits extending from a middle part to a rim part of the contact and in the latter, is formed in arc-like slots, which opening serves to guide an arc drawn when contact pieces are separated from each other to keep a contact surface in clear state. However, these contacts have disadvantages in that the spiral slits and a plurality of arc-like slots decrease mechanical strength of the electrical contact per se and a cost thereof becomes higher due to a formation of the slits or slots.

Another type electrical contact has been disclosed in U.S. Pat. No. 3,156,791, wherein an arcuate cross sectional slot is formed in a mating surface of the contact, which promotes the circulation of air to restrain heating and oxidation of the contact. This type contact has also a disadvantages in that it will become difficult to form the slot when a smaller contact is required in use for recent compact and accurate devices.

It has been found that the advantageous functions of the contract as disclosed in said U.S. Pat. No. 3,156,791 can attain by forming an opening in the contact. Therefore, a conventional button type clad contact has been prepared by forming a composite clad plate consisting of a plate of a contact stock such as silver and another plate of a carrier stock such as copper, stamping out from the clad plate discs and then punching out each disc to form a central opening therein. However, this method generates a scrap in large amount, due to the formation of the disc, to reduce a yield of the product in a level of about 30% and further, a recovering of the contact stock from the scrap requires a remarkable time and labour to increase a cost of the final product. While, as far as a conventional rivet type clad contact is concerned, it has been prepared by forming a clad rod with use of the contact stock and carrier stock, as in the button type one, treating the clad rod with use of a header to make the rod into a rivet-like form, and then punching out the formed clad contact to form a central opening or bore therein. In both types of such conventional clad contacts, please note that a hardness of the contat stock and carrier stock is not quite different and thus the punching out for forming the central opening or bore is carried out in the direction from the carrier stock side to the contact stock side, in view of a technical common sense to attain a working accuracy, but this causes a rising up of the carrier stock to a free or top surface of the contact segment formed by the contact stock, at a periphery of the central opening or bore to show a disadvantage of that in use, another contact will contact with the raised carrier portion of the contact to cause in early time period a welding therebetween during switching operations.

SUMMARY OF THE INVENTION

A primary object of the invention is to provide a clad type electrical contact for switches, relays, voltage regulators and the like, which has a central opening but does not show a welding over a long time period.

A specific object of the invention is to provide a button type clad contact which can be welded on a contact arm with a reliable strength.

Another specific object of the invention is to provide a rivet type clad contact having a long life.

Further object of the invention is to provide a method of making such a clad contact in a simple operation with a reasonable cost.

According to one of aspects of the invention, the object can be accomplished by an electrical contact comprising a clad body of a contact stock segment and a base stock segment, said clad body having a central opening and a thickness of the contact stock segment is made larger at a peripheral area of the opening.

In case of a double layered button type clad contact, it is preferable to have a plurality of small projections formed at a bottom or the base stock segment side thereof in a circular arrangement, so that the contact can be welded on a carrier element or arm of an elastic metal strip with a high connection strength to avoid a possible drop out from the element, due to an overcurrent passing through the contact. The projections may be changed into a circular projection. It is preferable that a diameter of the base segment is larger than that of the contact segment to make larger a thermal capacity and heat discharging area, which allow an increase of a switching current and otherwise make more smaller contact possible or save an amount of an expensive noble metal or its alloy, as the contact stock.

According to another aspect of the invention, the object can be accomplished by a method of making an electrical contact, which comprises steps of transfering materials which consists of a contact stock and a base stock to a position at front of a die pin of an inner die in a composite die; forwarding a first punch to insert the materials in a die bore of the composite die and press down the same to form a central blind hole at a side of the contact stock and simultaneously retracting the inner die to form another central blind hole at a side of the base stock; pressing and deforming the resulting material block by a second punch to dress one side thereof; and forwarding the die pin into the central blind hole to finally form a through opening. The materials may be of separate blocks of the contact stock and the base stock or a so-called clad block. It is important that the blind hole formation is initiated from the contact stock side of the clad block to obtain the desired contact and in other words, the final formation of the through opening may be made from either one side of the clad block with the blind hole in each side. A configuration of each die may be selected to form the rivet or button type clad contact, or the button type clad contact with a plurality of small projections or a circular ring at lower side thereof to ensure welding thereof on a elastic metal strip as a carrier or arm.

DESCRIPTION OF PREFERRED EMBODIMENTS

Figure 1:
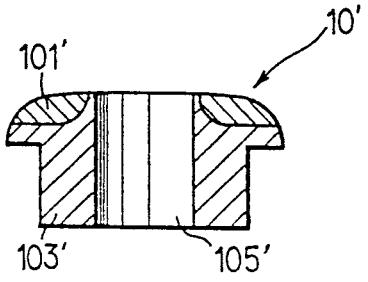
FIG. 1 PRIOR ART
FIGS. 1 and 2 are vertical sections of double and three-layered clad contacts formed by a conventional method.
Figure 2:
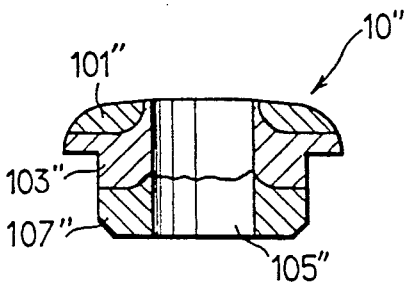
FIG. 2 PRIOR ART

FIG. 1 illustrates a double layered rivet type clad contact 10' manufactured by a conventional method utilizing a die-punch system. The clad contact 10' consists of a segment 101' of a contact stock such as silver and another segment 103' of a base stock such as copper and has a central through opening 105'. According to the conventional method, the clad contact is manufactured by treating a clad rod with a header to make it into a rivet-like form and then punching out the central opening. In this case, due to much the same in hardness between the contact and base stocks, the punching out has been carried out in the direction from leg to head for ensurring a working accuracy, so that a top portion of the base segment 103' rises up at upper side periphery of the central opening. as shown in FIG. 1. This will appear also in a conventional three-layered rivet type clad contact 10" as shown in FIG. 2. which consists of a first segment 101" of the contact stock, a second segment 103" of the base stock and a third segment 107" of the contact stock, and has a central opening 105". Both of such conventional contacts show a disadvantage that in use, another contact will contact with the rised-up base stock portion of said contact to cause in early time a fusional welding therebetween during switching operation.

Figure 3:
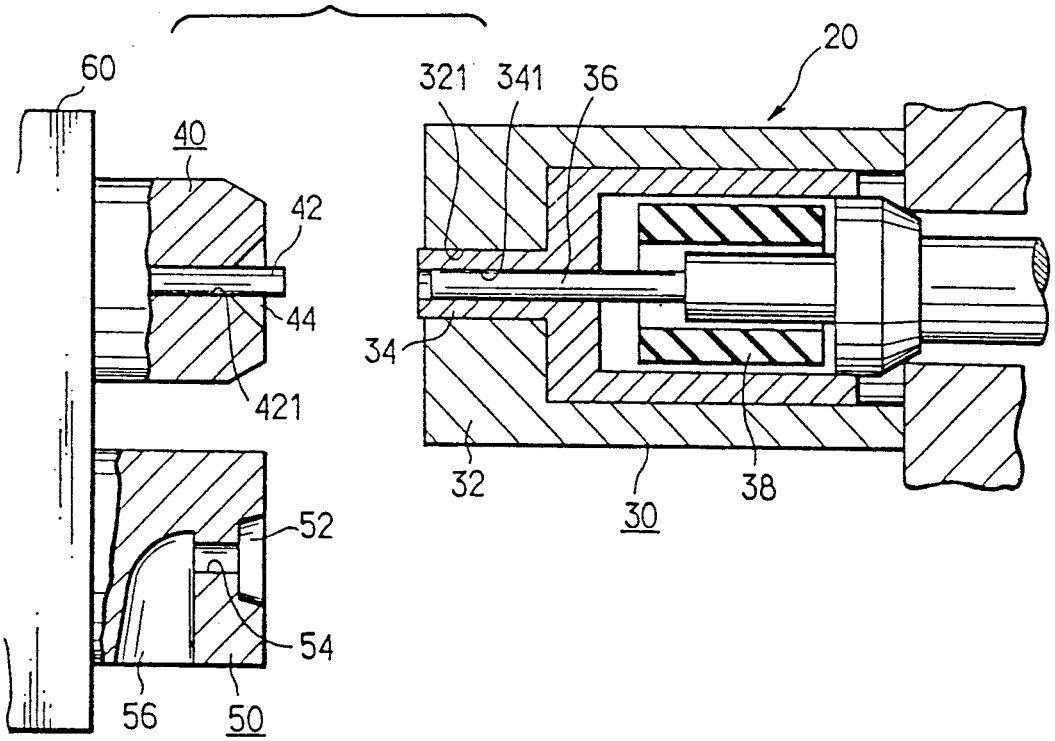
FIG. 3 is a diagramatic illustration of a device for carrying out a method according to the invention, in which essential parts thereof are shown in section.

While, a device 20 for carrying out a method according to the invention is diagrammatically illustrated in FIG. 3. The device 20 comprises a composite die 30, a first punch 40 and a second punch 50, latter two of which are supported by a punch holder 60 which can be moved in vertical direction, so that one of the punches mates with the composite die 30 to cooperate therewith. The composite die 30 has an outer die 32, inner die 34 fitted in an outer die bore 321 and a die pin 36 reciprocatively fitted in an inner die bore 341, inside of which is enlarged in diameter to accomodate a hollow cylindrical member 38 of an elastic material such as urethane rubber. In normal case, a free surface of the inner die 34 projects from that of the outer die 32 and the die pin 36 is in a position retracted in the inner die bore 341, as shown. The first punch 40 has a punch pin 42 movable in a pin bore 421 and has a cavity 44 at a free end surface of the punch to communicate with the pin bore 421. In normal state, a free end of the punch pin 42 is in the position projecting from the free end surface of the punch 40, as shown. The second punch 50 has a cavity 52 for forming a head of a contact, a bore 54 which communicates with the cavity 52 to allow an intrusion of the die pin 36 of the composite die 30, and a chute 56 communicating with the bore 54.

Figure 4A:
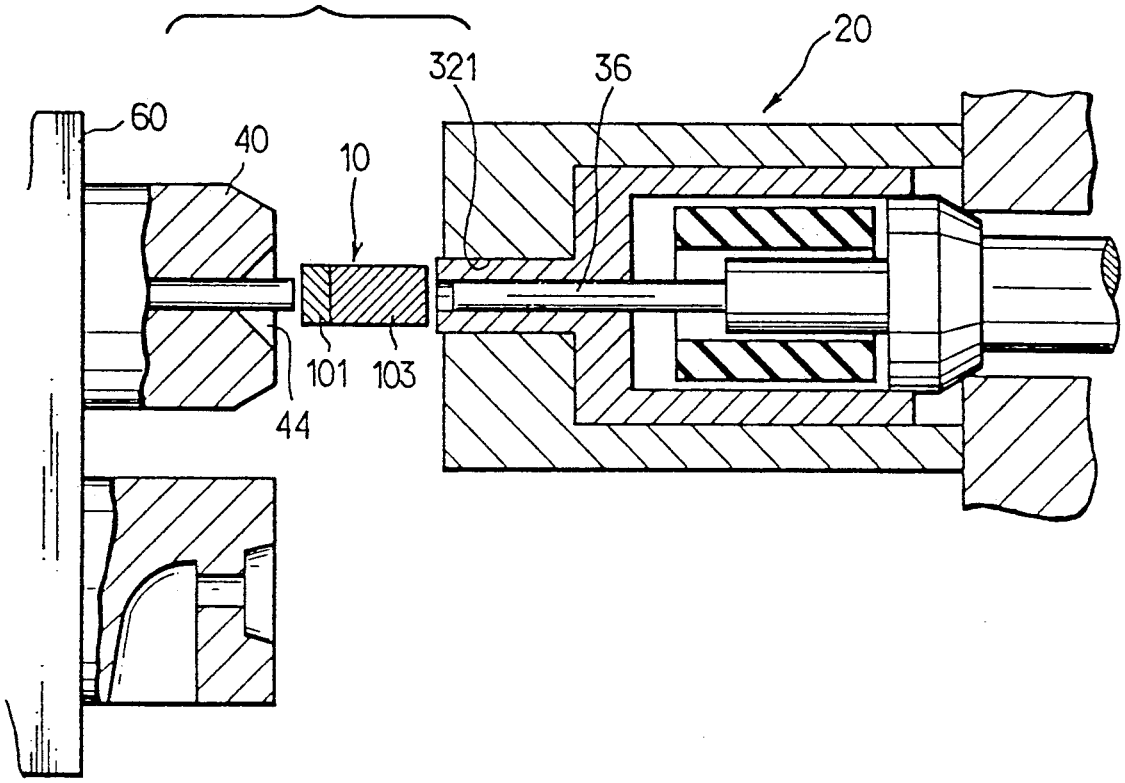
FIGS. 4*a* to 4*f* are illustrations of the device shown in FIG. 3 to show operation steps of the method.
Figure 4B:
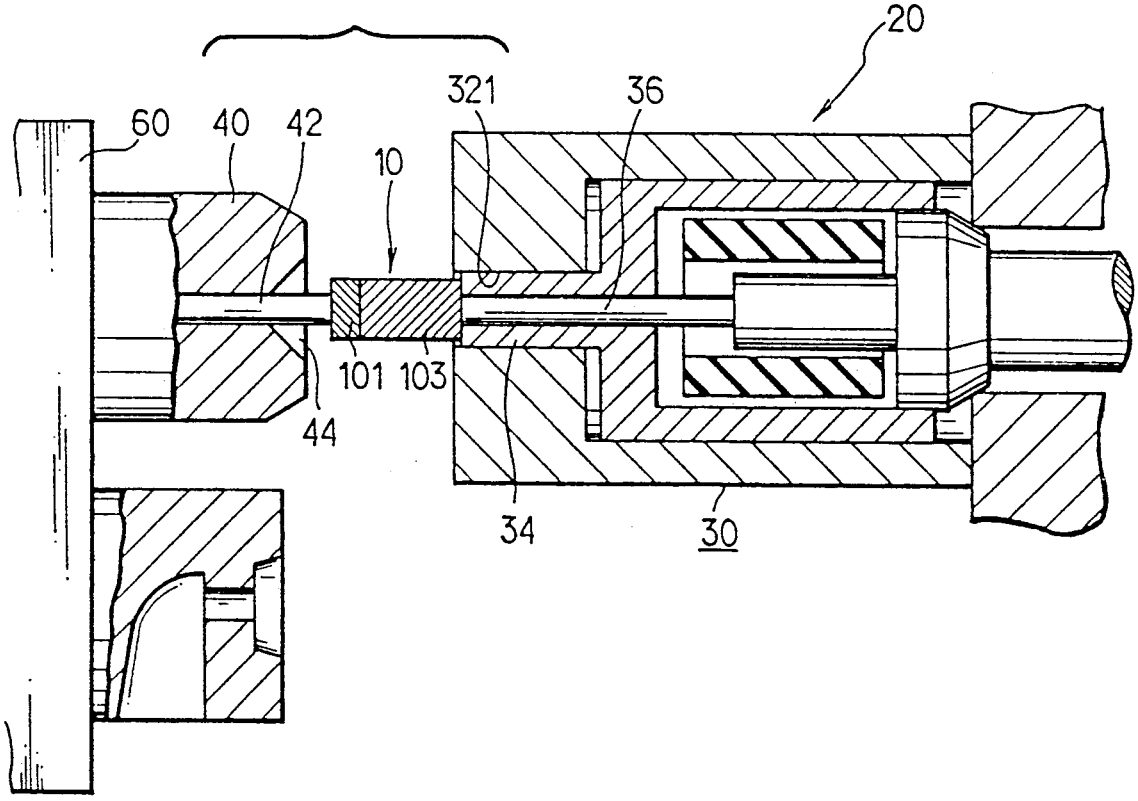
Figure 4C:
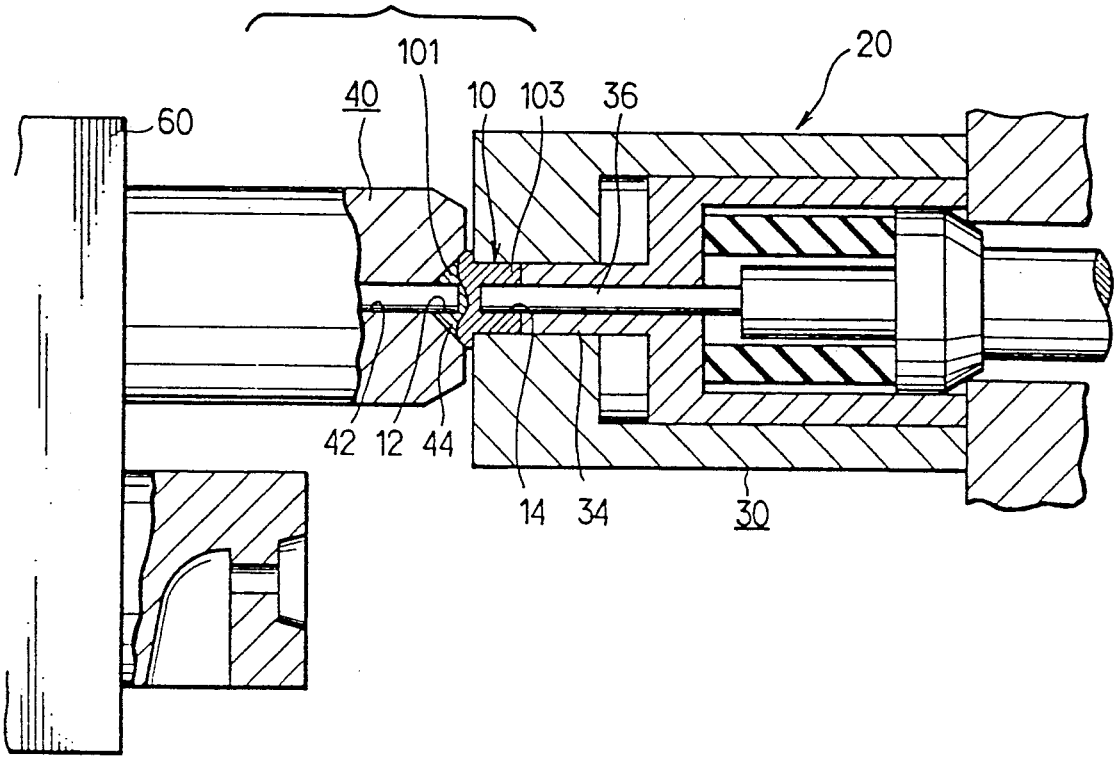
Figure 4D:
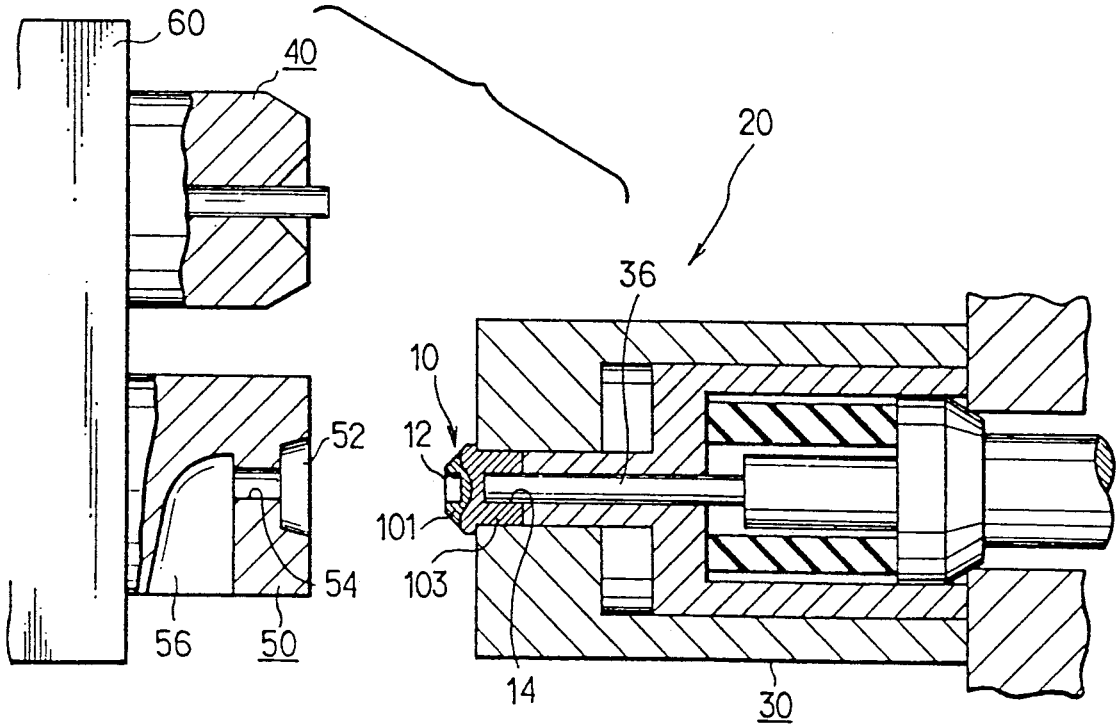
Figure 4E:
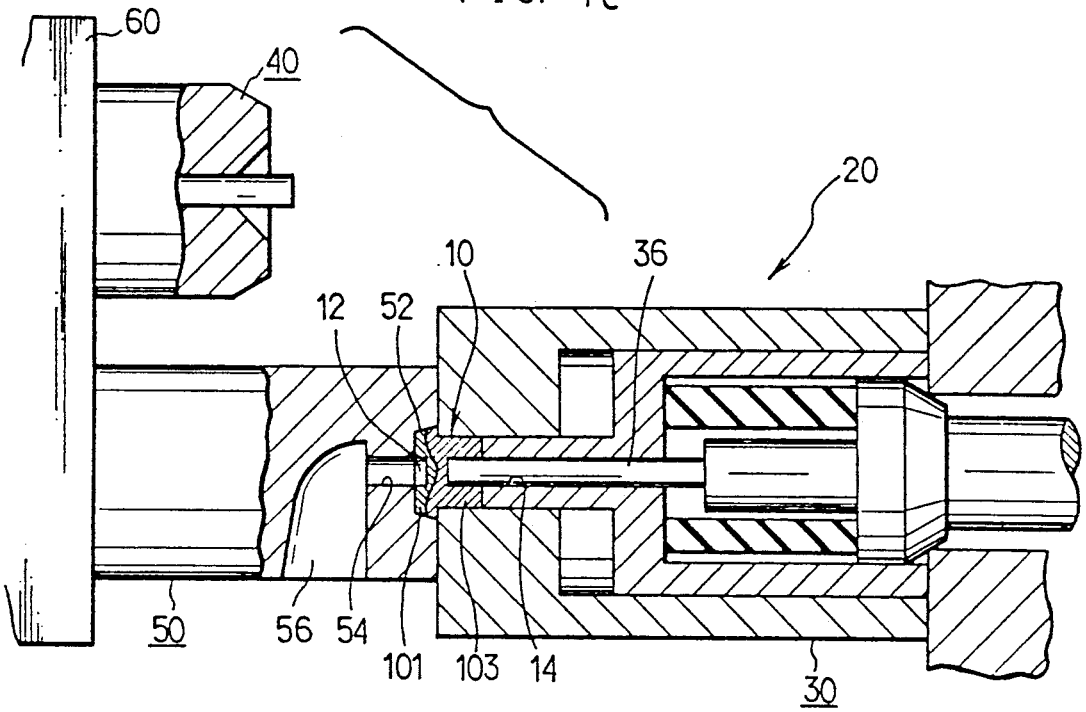
Figure 4F:
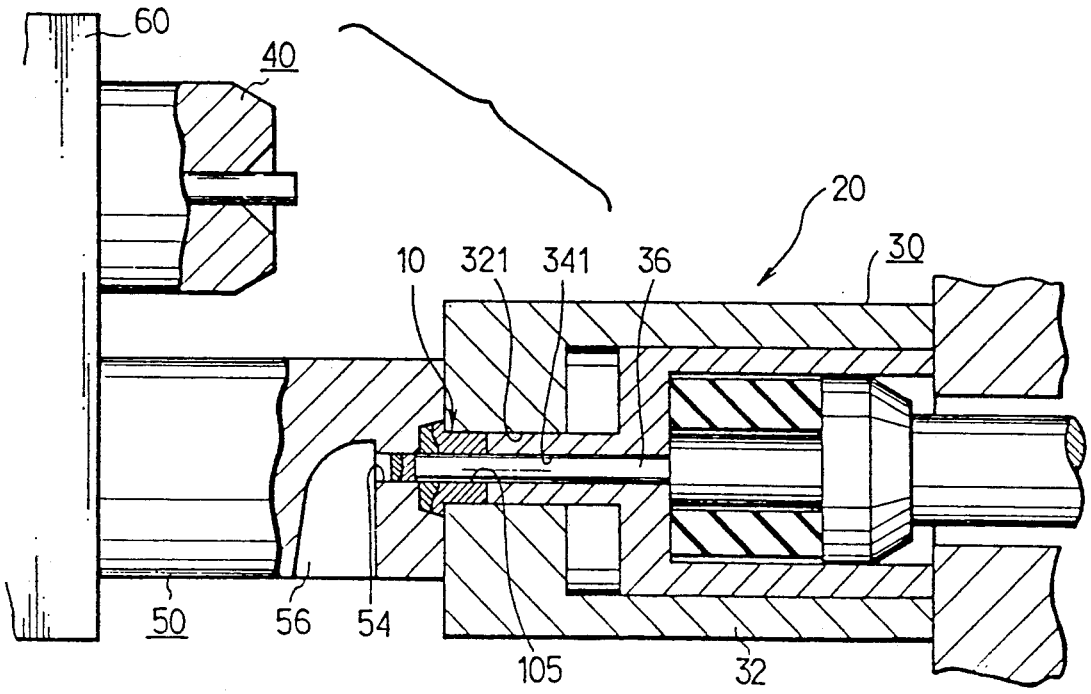

A method according to the invention to prepare a rivet type clad contact with use of the device 20 having such structure as stated above will be explained with reference to FIGS. 4*a* to 4*f*. In the first place, a cylindrical clad stock 10 is positioned between the composite die 30 and the first punch 40 which are oppositely arranged, as shown in FIG. 4*a*. The clad stock 10 was prepared by brazing a contact stock 101 of [Ag-CdO (12%)] having size of 2.5 mm in diameter and 1.2 mm in thickness and a base stock 103 of copper having a size of 2.5 mm in diameter and 4.0 mm in length. Then the first punch 40 is advanced to push the clad stock 10 with the punch pin 42 into the outer die bore 321 having an inner diameter of 3.3 mm, as shown in FIG. 4*b*. The first punch 40 is further advanced as shown in FIG. 4*c* to cause a deformation of the cylindrical clad stock 10, so that a central blind hole 12 is formed in the contact stock segment 101 and simultaneously therewith, another central blind hole 14 is formed in the base stock segment 103. After having retracted the first punch 40 in its original position as shown in FIG. 4*a*, the punch holder 60 is raised-up to make a centering of the second punch 50 with the composite die 20, as shown in FIG. 4*d*. Thereafter, the second punch 50 is advanced to deform the clad stock into that having a rivet-like outer-visual appearance, as shown in FIG. 4*e*. Then, the die pin 36 of the composite die 30 is advanced for punching out a central remaining area between the blind holes 12, 14 (see FIGS. 4*c* to 4*e*) to form a through opening or hole 105, as shown in FIG. 4*f*. A piece 16 to be formed by the punching operation is fed through the bore 54 to the chute 56 to recover the same. The resulting rivet type clad contact with central through opening is dropped from the composite die 30 and recovered, when the second punch 50 is returned to its initial position, the punch holder 60 is descended, so that the first punch 40 mates with the composite die 30, and the inner die 34 is returned to its initial position (see FIG. 4*a*).

In the above, the clad stock formed by brazing the contact stock segment with the base stock segment is employed but a separate contact stock segment and base stock segment may be employed since such segments can be bonded through an intial press operation into the clad stock.

Figure 5:
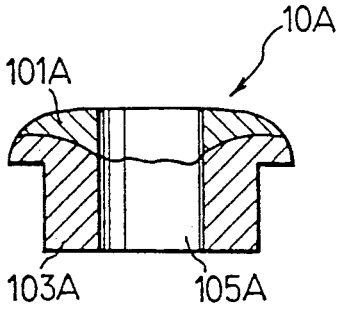
FIG. 5 is a vertical section of a double layered rivet type clad contact formed by a method similar to that as shown in FIGS. 4*a* to 4*f*.
Figure 6:
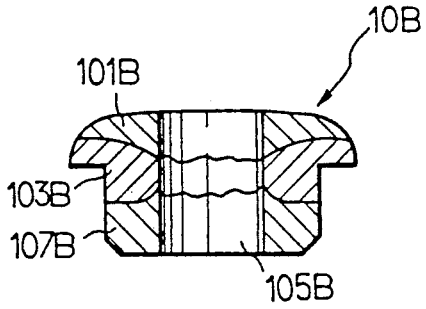
FIGS. 6 and 7 are vertical sections of three-layered rivet type clad contacts formed by a method similar to that as shown in FIGS. 4*a* to 4*f*.
Figure 7:
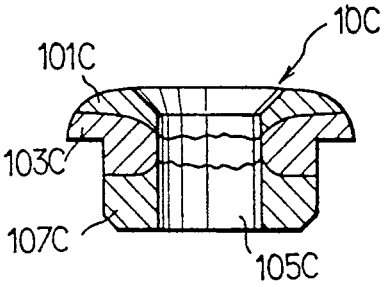

By modifying a configuration of the cavity in the second punch 50 or changing the starting clad stock 10, various rivet type clad contacts 10A, 10B and 10C as shown in FIGS. 5 to 7 can be prepared in a manner similar to the above, wherein 101A, 101B, 107B, 101C and 107C are contact stock segments, 103A, 103B and 103C base stock segments, and 105A, 105B and 105C through openings, respectively.

Figure 8:
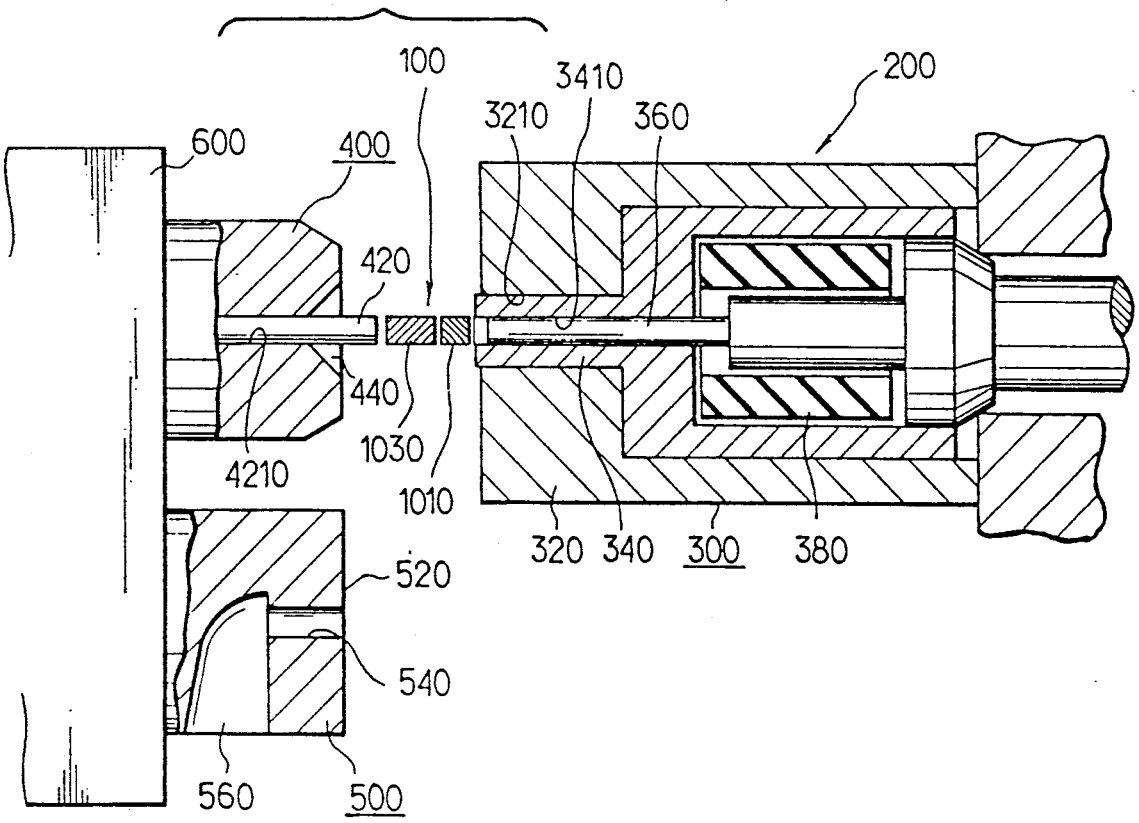
FIG. 8 is a illustration of another device similar to FIG. 3.

FIG. 8 shows an illustration of another device 200 which has a structure similar to the device as shown in FIG. 3 and thus structural elements for which are identified with reference numerals added "0" to those given in FIG. 3, provided that a stock 100 is formed from a separate contact stock segment 1010 and a base stock segment 1030, the stock 100 is pressed into an inner die bore 3410 from its contact stock segment side, and a plurality of small cavities 520 are circularly formed in second punch 500.

Figure 9:
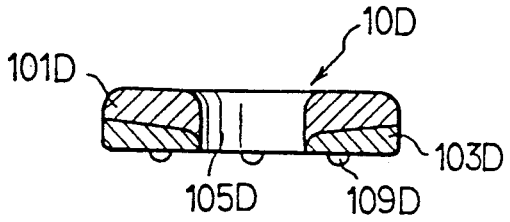
FIG. 9 is a vertical section of a double layered button type clad contact formed by the device as shown in FIG. 8.
Figure 10:
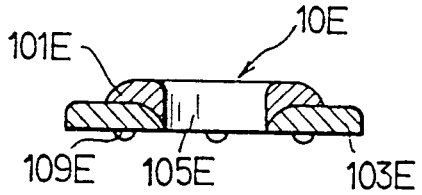
FIG. 10 is a vertical section of a double layered button type clad contact similar to that shown in FIG. 8.
Figure 11:
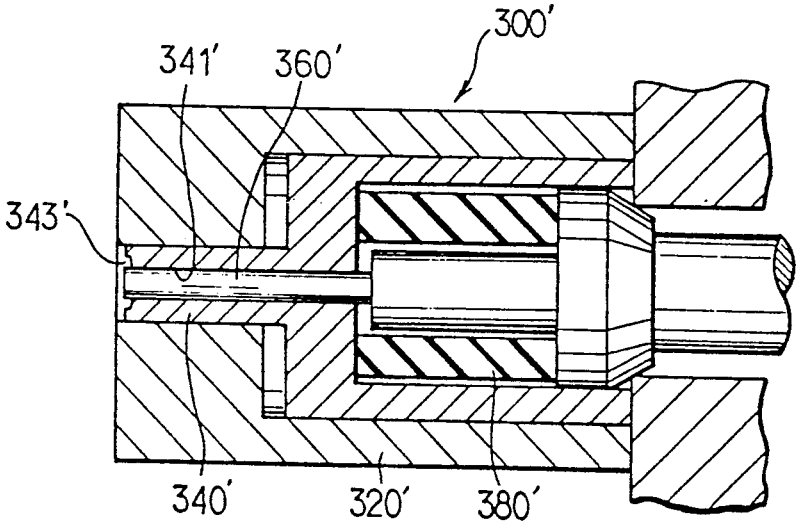
FIG. 11 is an illustration of a die which cooperates with the punch shown in FIG. 8 to form the contact as shown in FIG. 10.

If the device 200 is operated in the manner similar to those as given in FIGS. 4*a* to 4*f* and with use of the stock formed by, for instance a contact stock [Ag-CdO (12%)] of 1.8 mm in diameter and 1.9 mm in thickness and a base stock [Cu-Ni (4.5%)] (diameter of the inner die bore 341 was 1.8 mm), a button type clad contact 10D as shown in FIG. 9 can be formed, wherein the contact stock segment is indicated by 101D, base stock segment by 103D, through opening by 105D, and projections by 109D. The projections serve to a good welding when the contact is welded to a carrier such as an elastic metal plate. The welding ability can be increased by another button type clad contact 10E as shown in FIG. 10, which can be prepared with use of another type composite die 300' as shown in FIG. 11, which has similar structure with that shown in FIG. 8 and is different from the latter only in configuration of free end surface of an inner die 340' to form a cavity 343'.

The invention will now be further explained with reference to a Comparative Test Example.

SAMPLES

Test Sample 1

General configuration;

A double layered rivet type clad contact as shown in FIG. 5.

Diameter at head portion; 4.0 mm
Thickness in head portion; 0.8 mm
Round at head portion; 10 R
Diameter at leg portion; 3.0 mm
Length in leg portion; 1.2 mm
Contact stock material in head portion; Ag
Base stock material in remaining portion; Cu
Inner diameter of central through opening; 1.5 mm
Thickness of contact stock material at periphry of central through opening; 0.7 mm This sample contact is assembled into a 1a-type relay as a movable contact, while using as a stationary contact a double layered rivet type clad contact with no central opening, details of which stationary contact are given below.

Diameter at head portion; 4.0 mm
Thickness in head portion; 0.8 mm
Diameter at leg portion; 3.0 mm
Length in leg portion; 1.2 mm

Test Sample 2

General configuration;

A three-layered rivet type clad contact as shown in FIG. 6.

Diameter at head portion; 3.8 mm
Thickness in head portion; 0.7 mm
Round at head portion; 10 R
Diameter at leg portion; 3.0 mm
Length in leg portion; 1.3 mm
Contact stock material in head portion; Ag
Base stock material in middle section; Cu
Contact stock material in leg portion; Ag
Inner diameter of central through opening; 1.2 mm
Thickness of contact stock material at periphery of central through opening; 0.4 mm (at head side) and 0.7 mm (at leg side)

This sample contact is assembled into a 1c-type (transfer type) relay as a movable contact, while using as a stationary contact having particulars with those employed for the 1a-type relay as given above. The head of the movable contact was bonded at normally open side and a test is carried out at normally open contact side only.

Test Sample 3

General configuration;

A three-layered rivet type clad contact as shown in FIG. 7.

Details; same with those in Test Sample 2.

This sample contact is assembled into a 1c-type relay as a movable contact and other factors are same with those in Test Sample 2. The test was carried out as for the Test Sample 2.

Control Sample 1

General configuration;

A double layered rivet type clad contact as shown in FIG. 1.

Details; same with those in Test Sample 1.

This sample contact is assembled into a 1a-type relay as a movable contact and other factors are same with those in Test Sample 1, to carry out the test.

Control Sample 2

General configuration;

A three-layered rivet type clad contact as shown in FIG. 2.

Details; same with those in Test Sample 2.

This sample contact is assembled into a 1c-type relay as a movable contact and other factors are same with those in Test Sample 2 to carry out the test.

Test Conditions

Voltage; AC 100 V, 50 Hz
Current; 40 A (rushing current), 10 A (normal)
Load: Resistance loading (2 step switching)
Switching cycles; until welding occurs
Contact force; 40 g
Opening force; 45 g

Results

Results are shown in following Tables.

TABLE 1

| Samples | (Test in 1a-type relay) Switching cycles until welding occurs |
|---|---|
| Test sample 1 | 105,000 |
| Control sample 1 | 41,200 |

TABLE 2

| Samples | (Test in 1c-type relay) Switching cycles until welding occurs |
|---|---|
| Test sample 2 | 94,300 |
| Test sample 3 | 96,600 |
| Control sample 2 | 38,500 |

What is claimed is:

1. A method of making an electrical contact, which comprises steps of transfering materials which consists of a contact stock and a base stock to a position at front of a die pin of an inner die in a composite die; forwarding a first punch to insert the materials in a die bore of the composite die and press down the same to form a central blind hole at a side of the contact stock and simultaneously retracting the inner die to form another central blind hole at a side of the base stock; pressing and deforming the resulting material block by a second punch to dress one side thereof; and forwarding the die pin into the central blind hole to finally form a through opening.

2. A method as claimed in claim 1. wherein said materials are supplied as a separate contact stock block and base stock block.

3. A method as claimed in claim 1, wherein said materials are supplied in the form of clad one.

* * * * *